US005929730A

United States Patent [19]

Hendel

[11] Patent Number: 5,929,730

[45] Date of Patent: Jul. 27, 1999

[54] ELECTROMAGNETIC RELAY AND METHOD OF MANUFACTURE THEREOF

[75] Inventor: Horst Hendel, Berlin, Germany

[73] Assignee: Siemens Aktiengesellschaft, Munich, Germany

[21] Appl. No.: 08/723,478

[22] Filed: Oct. 9, 1996

[30] Foreign Application Priority Data

Oct. 9, 1995 [DE] Germany ..... 195 37 612

[51] Int. Cl.[6] ..... H01H 51/22

[52] U.S. Cl. ..... 335/78; 335/83; 335/85; 335/128; 335/267; 335/268

[58] Field of Search ..... 335/78–86, 128, 335/202, 267, 268

[56] References Cited

U.S. PATENT DOCUMENTS

| | | | |
|---|---|---|---|
| 4,193,052 | 3/1980 | Hayden | 335/128 |
| 5,239,281 | 8/1993 | Tomono et al. | 335/78 |

FOREIGN PATENT DOCUMENTS

| | | |
|---|---|---|
| 25 15 890 A1 | 10/1976 | Germany . |
| 38 43 359 C2 | 7/1989 | Germany . |
| 38 34 283 A1 | 4/1990 | Germany . |
| 42 33 807 A1 | 4/1993 | Germany . |
| 42 44 247 A1 | 7/1994 | Germany . |

*Primary Examiner*—Michael L. Gellner
*Assistant Examiner*—Raymond M. Barrera
*Attorney, Agent, or Firm*—Hill & Simpson

[57] ABSTRACT

A single or double relay is provided. The relay has a base and a coil body. Each relay has a coil with an axis parallel to the bottom side of the base, an angled yoke and a plate-shaped armature. The armature is connected to a contact spring that is split into two fork-like legs. A contact leg carries a movable contact and a terminal leg that is connected to a spring carrier in the region in front of the movable armature end. With the double relay, the two armatures lie parallel at opposite ends of the base. The design yields a simple assembly with good heat dissipation particularly for a double relay for high switching currents.

17 Claims, 6 Drawing Sheets

ELECTROMAGNETIC RELAY AND METHOD OF MANUFACTURE THEREOF

BACKGROUND OF THE INVENTION

1. Field of the Invention

The present invention is directed generally to electromagnetic relays and methods of manufacturing electromagnetic relays.

2. Description of the Prior Art

Relay structures for single and double relays are disclosed in DE 4 233 807 A1. However, the second yoke leg disclosed in DE 4 233 807 A1 does not extend next to the coil but above the coil. As standard in such designs, the armature is secured to the yoke via the contact spring which overlaps the yoke/armature junction. The connection of the contact spring to the yoke requires comparatively complicated manufacturing steps and results in an undesirably long current path up to the terminal for high switching currents. In an embodiment with a double relay, two identical single relays are either placed next to one another with parallel axes or opposite one another with their axes in alignment. In the latter instance, all contacts lie in the middle between the two systems resulting in limited access of fresh air to the contacts and therefore poor heat dissipation.

In a double relay according to DE 3 843 359 C2, two identical relay blocks are arranged on a base, symmetrically, relative to the middle of the base. The contact elements extend laterally across one another. Since the heat arising at the contacts can also represent a problem in this case, the contact elements require cooling members.

A change-over relay is disclosed by DE 3 834 283 A1. Two magnet systems are arranged in a symmetrical fashion to one another on a base. Two U-shaped, layered cores have their middle sections lying against one another and the armatures of the magnet systems lie at opposite ends. In this case, too, the armatures are seated at the respective outside leg of the core via the contact springs. The assembly of the discrete parts is relatively complicated due to the lack of a carrying coil member.

Accordingly, an improved relay design is desired which facilitates the combination of two relays on one base surface and which provides for a simplified manufacturing process for such relays. Further, an improved relay design is desired which improves the heat dissipation during operation.

SUMMARY OF THE INVENTION

An object of the present invention is to fashion a relay structure of the type disclosed in DE 42 33 807 A1 but with a single relay as well as a double relay that can be manufactured with as many common parts as possible. Further, an object of the present invention is to provide a design that is especially well suited for an automated manufacture and that provides a relay that can switch higher currents without difficulty. Additionally, an especially beneficial manufacturing method for this relay is recited.

The present invention provides an electromagnetic relay with a base defining a bottom side on which at least one switch system is provided. The switch system includes: a coil body with a winding and an axial core arranged on the base with its axis parallel to the bottom side; and angled yoke with a first leg coupled to an end of the core, and a second yoke leg which extends next to the winding; an approximately plate-shaped armature is seated at the free end of the second yoke leg and forms a working air gap together with the free end of the core; at least one fixed contact carrier having a fixed contact is anchored in the base; and a contact spring connected to the armature which carries a movable contact with a movable contact leg that interacts with the fixed contact.

In a relay of the species initially cited, this goal is inventively achieved with the following, additional features:

- a spring carrier is anchored in the base next to the at least one fixed contact carrier in the region in front of the movable armature end; and
- at one end section, the contact spring carries the bearing end of the armature and is divided in a fork-like fashion in the direction toward the movable end of the armature, the two divided legs of the armature lying above one another, namely at least one terminal leg and at least one contact leg, whereby the terminal leg is connected to the spring carrier and the contact leg carries the movable contact.

In the inventive relay, thus, the armature, has its principal plane residing perpendicular to the bottom surface of the base and is pivotable around a vertical axis. The armature only lies against the yoke edge without being connected to the yoke via an armature spring. As a result thereof, the various parts of the relay, namely the coil assembly with the yoke and the core and the armature assembly with the armature and the contact spring, can be separately mounted on the base in succession. It is thereby advantageous that both the fixed contact carrier or carriers as well as the spring carrier are anchored in the base in the region in front of the movable armature end. All terminals that carry load current thus lie at one side of the relay system, so that the coil terminals can be arranged remote therefrom at the other side.

In a preferred embodiment, the terminal leg of the contact spring has a fastening section that is bent off approximately at a right angle, the proceeds transversely in front of the movable armature end and that is connected to the spring carrier. This fastening section can lie against an insulating wall of the base that is perpendicular relative to the bottom side and that, for example, partially embraces the fixed contact carrier or carriers. It is also advantageous when a solder tab of the spring carrier respectively lies flat against the fastening section and is soldered or, respectively, welded thereto. In this case, the fastening section of the contact spring can be clamped between said insulating wall of the base and the solder tab of the spring carrier upon assembly and, thus, can be pre-fixed, so that a special holder or tool is not required for the actual soldering or welding process. Further, in the pre-fixing, the fastening section can also be clamped to a base projection with a spring tab. In another embodiment, the fastening section can also form a spring sleeve that can be plugged onto a preferably round spring carrier.

As already mentioned, the inventive relay structure can be advantageously employed in a single relay. Additional advantages, however, derive when a double relay is fashioned with this structure. In this case, two switch systems are preferably arranged such on the base opposing one another in a symmetrical fashion relative to a plane perpendicular to the coil axis. The two first yoke legs, disposed an insulating distance apart from each other, are arranged parallel to one another and the two armatures and are seated parallel to one another at opposite ends of the relay. Given such an arrangement, the contacting parts of the two switch systems are arranged far away from one another at outsides of the double relay, so that the resulting heat is easily dissipated. Although the mirror-image arrangement and design of the two switch systems requires that all discrete parts cannot be employed fully identically in both switch systems as in the case of identical switch systems, the mirror-symmetrical modification effects only a relatively few parts given that, in an automated manufacture, parts can be pre-fabricated from common bands of material and assembled practically without added outlay. Above all, this mirror-symmetrical arrangement of the two switch systems also has advantages in the mounting and in the total number of discrete parts. For example, a common double coil body can be employed for both switch systems in this arrangement. Further, the spring carriers for both switch systems can also be pre-fabricated and mounted of one piece and separated only after the mounting.

An advantageous method for manufacturing an inventive single or double relay comprises the following method steps:

a) plugging the fixed contact carriers and the spring carrier or carriers into the base;

b) providing at least one coil body with at least one winding, at least one core and at least one yoke;

c) attaching said coil body to the base;

d) connecting at least one armature connected to a contact spring placed onto the base; and e) connecting the contact spring to the spring carrier via its fastening section.

It is also advantageous that two fixed contact carriers and/or spring carriers that belong to one or to two different switch systems are first connected into the base and are only subsequently separated from one another. An especially advantageous method for assembling the core and yoke is comprised therein because the yoke for the switch system has its first yoke leg disposed between and held in channels in the slotted coil flange facing away from the armature. The core is plugged into the coil body until its front end lies on the flat side of the first yoke leg. The core is then welded to the first yoke leg, preferably by resistance heating, or is hard-soldered thereto, whereby a copper surface coating of these parts preferably acts as hard solder.

BRIEF DESCRIPTION OF THE DRAWINGS

The invention is explained in greater detail below with reference to exemplary embodiments illustrated in the following drawings.

DETAILED DESCRIPTION OF THE PRESENTLY PREFERRED EMBODIMENTS

Figure 1:
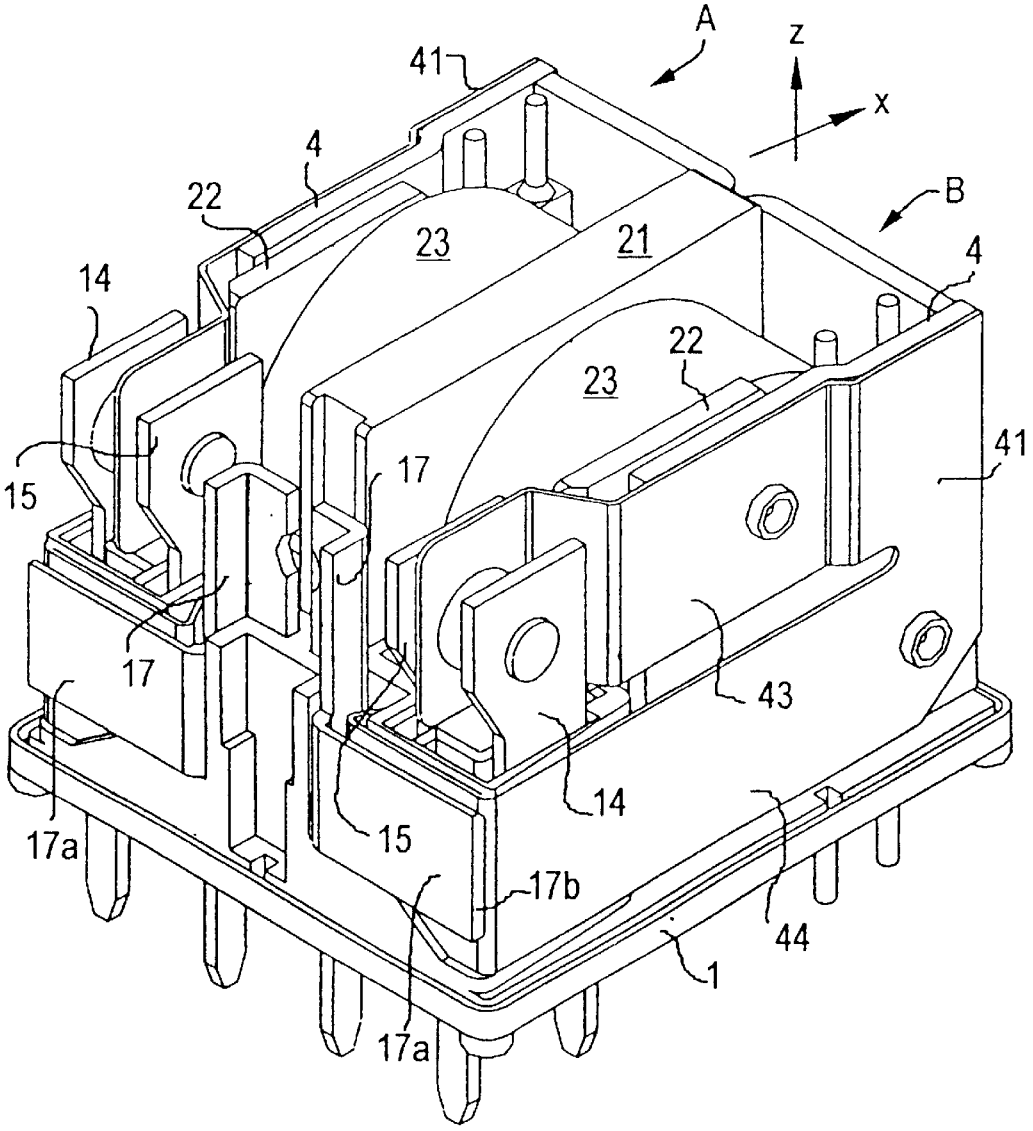
FIG. 1 is a perspective view of a double relay, fabricated in accordance with the present invention and shown without a cover.
Figure 2:
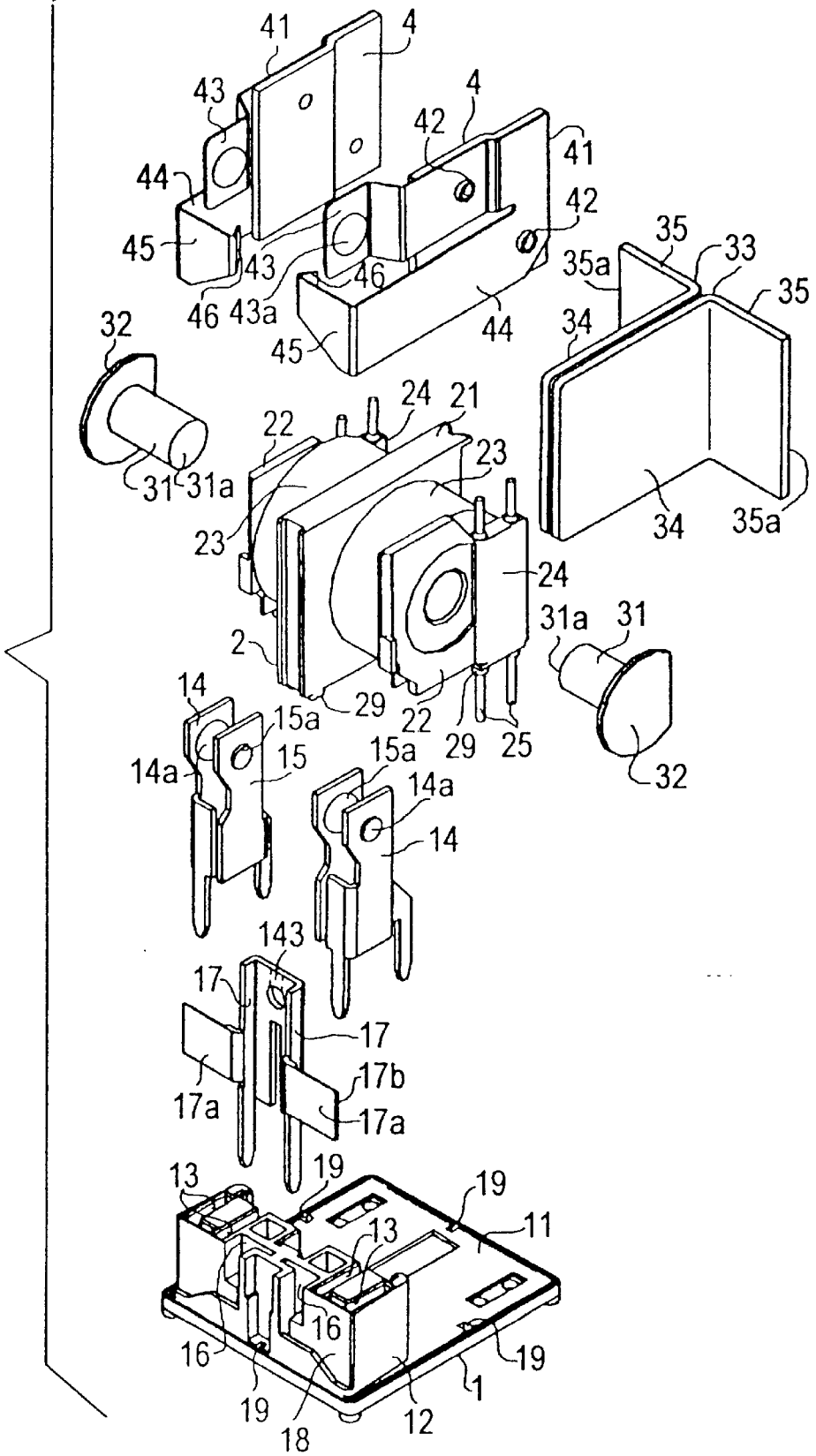
FIG. 2 is an exploded view of the individual parts of the relay of FIG. 1.

The relay illustrated in FIGS. 1 and 2 has a base 1 on which two switch systems A and B are arranged symmetrically in a mirror image relationship relative to a symmetry plane defined by the coordinates x and z in FIG. 1. Since all parts in the two switch systems A and B are either mirror images of one another and have the same function, the same reference characters are employed for both switch systems.

The base 1 is essentially designed as a flat plate that defines a bottom side 11. A projection 12 is attached to the bottom surface 11 and extends perpendicularly upward. The projection 12 is fashioned in a labyrinth-like manner in order to form plug-in channels 13 for two pairs of fixed contact carriers 14 and 15 as well as plug-in channels 16 for two spring carriers 17. The fixed contact carriers 14, 15 and the spring carriers 17 respectively emerge from the underside of the base 1 with terminal pins. The fixed contact carrier 14 respectively carries a break contact 14*a*, whereas the fixed contact carrier 15 is provided with a make contact 15a. Each of the two spring carriers 17 has a solder tab 17*a* bent off to the side.

Figure 6:
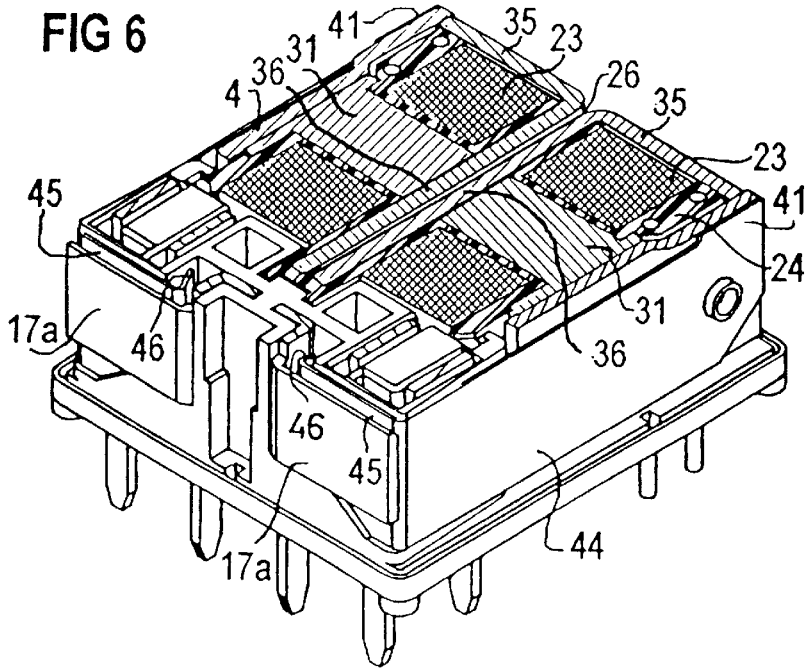
FIG. 6 is a horizontal sectional view of the relay illustrated in FIG. 1.

A double coil body 2 is disposed on the base 1. It has a slotted middle flange or wall 21 lying in the system plane between the two switch systems and two end flanges or walls 22, whereby a winding 23 is respectively arranged between the middle flange 21 and each of the end flanges 22. At the side facing away from the spring carriers 14 and 15, each of the end flanges 22 has a flange projection 24 with two coil terminal pins shown at 25 anchored thereto. A core 31 with a pole plate 32 at its outer end is inserted from the outside into the coil body within each winding 23 so that the pole plate 32 comes to lie partially in a depression or recessed portion of the end flange 22. The otherwise round pole plate 32 is respectively cut at one side toward the flange projection 24 to accommodate the projection 24. Further, each switch system has an angled yoke 33 with a first yoke leg 34 and a second yoke leg 35. Each pair of legs 34, 35 having their planes residing perpendicular to one another and perpendicular to the bottom side 11. The two first yoke legs 34 are plugged into a lateral opening 26 of the middle flange 21 parallel to one another (also see FIG. 6). This slotted opening in the middle flange 21 includes a middle web or wall 27. As a result, two channels 28 are formed to accommodate the yoke legs 34. Each yoke legs 34 being inserted into a respective channel 28. At the same time, the thickness of the web 27 assures an insulating distance between the two yoke legs 34.

Figure 5:
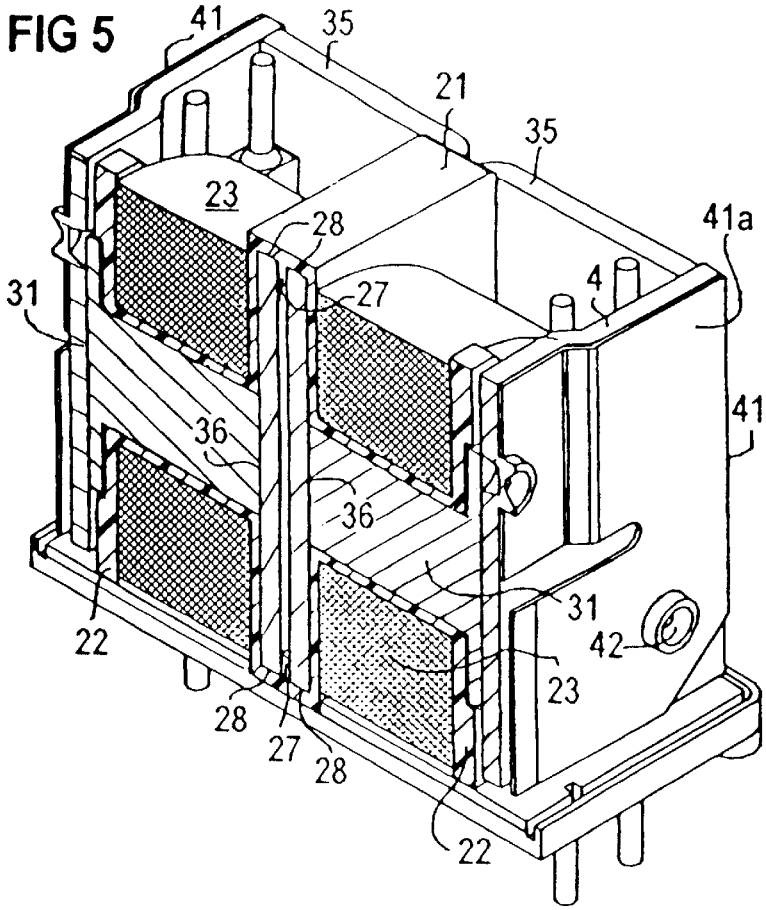
FIG. 5 is a vertical sectional view of the relay illustrated in FIG. 1.

An approximately plate-shaped armature 4 is disposed perpendicular to the bottom side 11 of the base 1. In the embodiment illustrated in FIG. 1, the armature 4 is slightly crimped to accommodate the shape of the coil body 23. The armature 4 is seated at the free terminating edge 35*a* of the second yoke leg 35 without being connected to the yoke 33 via a bearing spring of the like. The bearing and holding of the armature 4 is provided by a contact spring 41 that has an end section 41*a* (see FIG. 5) lying laterally on the armature and that is connected to the armature via one or two rivets 42. Proceeding from the end section 41*a*, the contact spring 41 is split in fork-like fashion in the direction toward the free armature end and thus forms a contact leg 43 with a movable middle contact 43*a* and a terminal leg 44. All sections of the crimped and bent contact spring 41 reside perpendicularly relative to the bottom side 11 so that the contact leg 43 essentially lies above the terminal leg 44. A fastening section 45 is bent off approximately perpendicularly at the terminal leg 44. The free end of the fastening section 45 carries a spring tab 46 which is bent in a hook-like manner in an inward direction. The fastening section 45 is plugged in between a vertical insulating wall 18 of the base projection 12 and the solder tab 17*a* of the spring carrier 17. The fastening section 45 is also clamped to the projection 12 of the base 1 with the spring tab 46. Moreover, the solder tab 17*a* is conductively connected to the fastening section 45, preferably by soldering or welding.

After excitation of the coil 23, the armature 4 is attracted to the pole plate 32, whereby, via the contact leg 43, the movable middle contact 43*a* is switched over from the break contact 14*a* onto the make contact 15*a*. The two switch systems can be actuated individually or in common. When the windings 23 of the two systems are excited in the same direction in series so that the magnetic fluxes in both cores lie in series, a mutual supporting of the systems is achieved for the purpose of an easier response. Of course, it is also possible to employ the two switch systems together as a repoling relay. In this case, the two spring carriers 17 could remain joined, as shown in FIG. 2, and the break contact carriers 14 as well as the two make contact carriers 15 could be respectively externally connected to one another.

Figure 3:
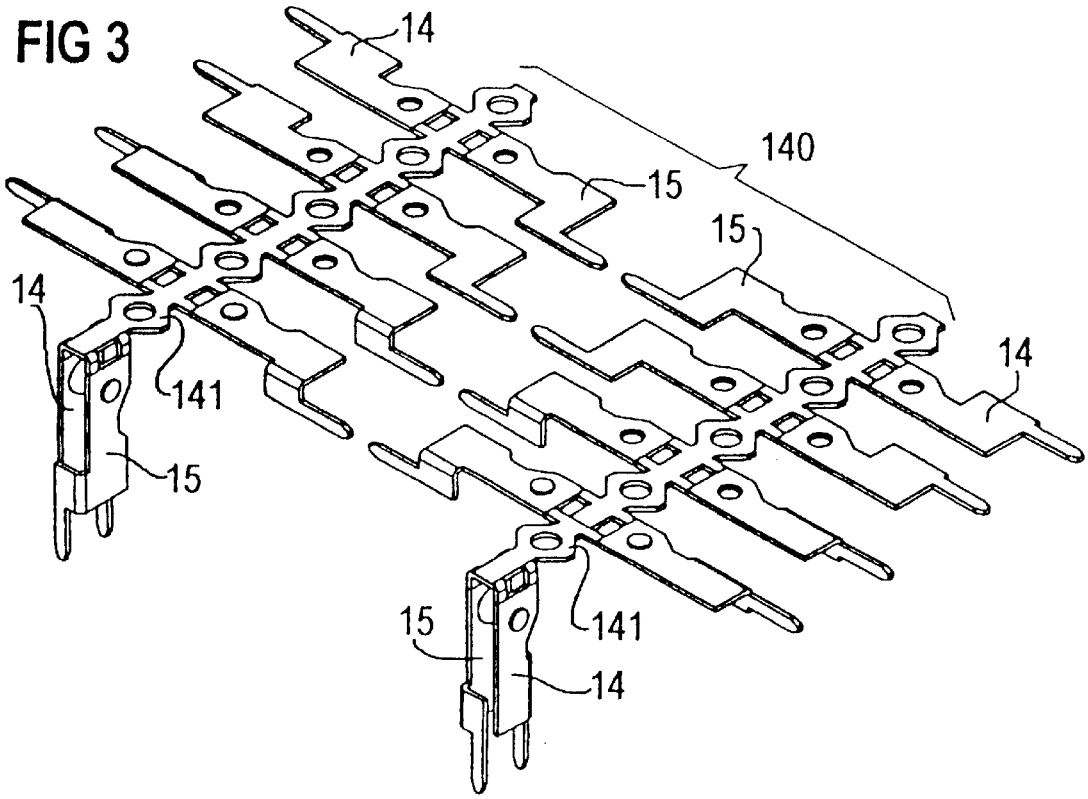
FIG. 3 is a perspective view of a double metal band for the fabrication and mounting of a pair of fixed contact carriers for the double relay illustrated in FIG. 1.
Figure 4:
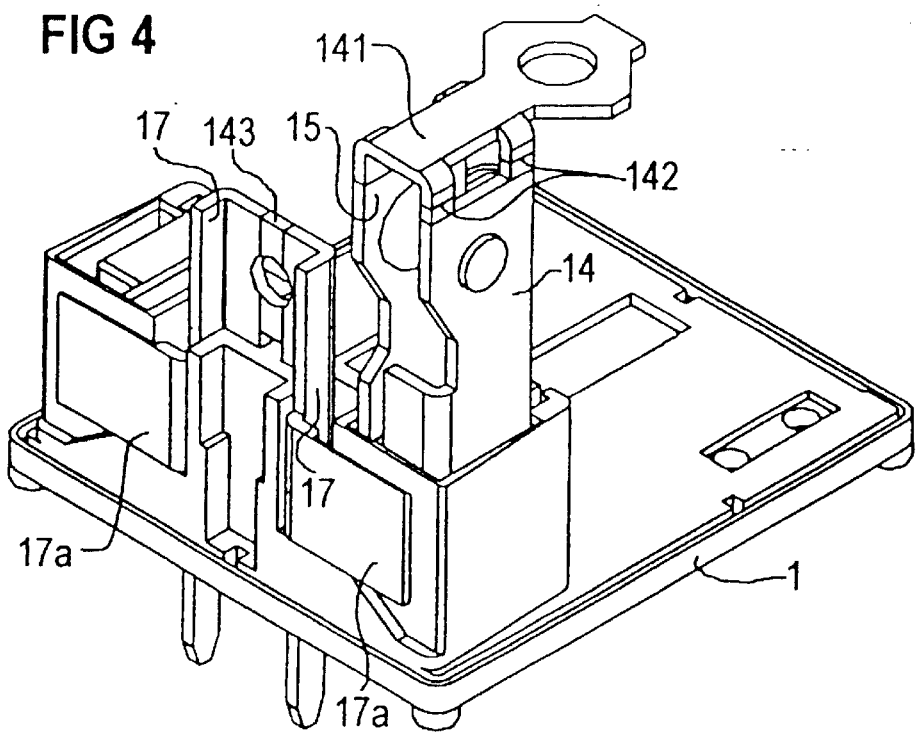
FIG. 4 is a perspective view of a base of the relay illustrated in FIG. 1 particularly illustrating the mounting of the fixed contact carriers and spring carriers.

In the manufacture of relays in accordance with the present invention, the base 1 is first equipped with the contact carriers 14, 15. As shown in FIG. 3, the fixed contact carriers 14 and 15 for both switch systems can be simultaneously cut free in pairs from a band 140 and bent into their ultimate shape. FIG. 3 shows the respective shape in the last five pairs of fixed contact carriers 14, 15. In the last phase, the fixed contact carriers 14, 15 respectively belonging to one another in pairs are bent into a position parallel to one another. However, they are still connected at the upper side with their guide section 141. They are thus cut off in pairs together with this guide section 141 and, according to the illustration in FIG. 4, plugged into their respective plug-in channels 13. Subsequently, the guide section 141 is cut off at the parting points 142. Only then are the two fixed contact carriers separated from one another. Preferably, the second pair of fixed contact carriers 14 and 15 for the second switch system is inserted into the base and parted simultaneously with the first pair. As shown in FIG. 4, the two spring carriers 17 for the two switch systems are inserted into the base 1 interconnected and only subsequently parted from one another at the parting section 143.

During assembly, the two cores 31, are inserted into the double coil body 2, so that the respective core 31 has its inner face end 31 a lying against the flat side of the yoke leg 34. Subsequently, a welding current is conducted across the respective yoke 33 and the respective core 31, this effecting a welding or a hard soldering of the two parts due to resistance heating at the point of contact. In this hard soldering process, the copper coating of inner end 31 a of the core 31 and/or yoke 34 that is already present as surface treatment serves as hard solder. A nearly gap-free connection between the core 31 and the yoke 33 derived in this way, the magnetic resistance being minimized as a result thereof. The butted welding of the core to the yoke leg 34 that is provided here can be especially advantageously implemented when the yoke is composed of a thin and space-saving sheet metal, i.e., for example, having a thickness of <1 mm. The magnetic saturation values for thin sheet metals that thereby take effect likewise have a positive effect on the magnetic circuit.

This type of butted welding or soldering of the core can be implemented in the inventive relay because the first yoke leg 34 is guided and held in stable fashion in the channels 28 of the middle flange 21. Since the core 31 itself is held in the coil body, the joining location 36 (see FIGS. 5 and 6) is not loaded with any torque applying forces which could jeopardize the integrity of the solder connection. Further, the two core-yoke connections can be simultaneously produced. To this end, a contact sheet (not shown) is connected to the one pole of the welding current source is introduced into the insulating gap between the two first yoke legs 34. When the two cores are then connected to the other pole of the welding current source, then, the two connecting points 36 can be simultaneously welded or hard-soldered. The contact sheet is subsequently withdrawn from the coil body. The coil body 2 equipped with the cores and yokes is positioned on the base, whereby retainer noses 29 at the middle flange 21 and at the flange projections 29 engage into correspondingly undercut recesses 19 of the base.

The two armatures 4 with the contact springs 41 bent in a mirror image relationship to one another are inserted into the base 1 after the coil body 2, whereby the fastening section 45 of the respective contact spring is inserted between the insulating wall 18 and the solder tab 17*a*. The fastening section 45 is clamped firmly against the projection 12 of the base by the spring tab 46. Preferably, the solder or attachment tab 17*a* is provided with a tin coat 17*b* on the side facing toward the fastening section 45 so that it can be soldered to the fastening section 45 of the contact spring 41 with the assistance of a heat source, such as a TIG arc. However, a soldered or welded connection with laser or some other heat source would also be possible.

Since the free ends of the fixed contact carriers 14 and 15 with the fixed contacts 14*a* and 15*a* project beyond the terminal leg 44 or, respectively, the fastening section 45 of the contact spring, they are easily accessible for a potentially required bending adjustment.

Figure 7:
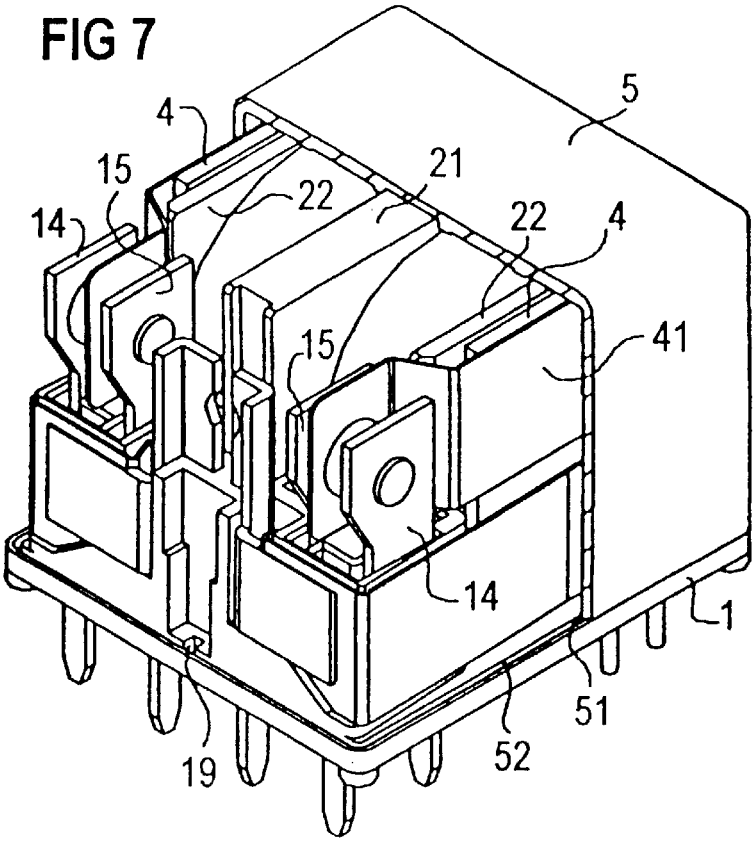
FIG. 7 is a perspective view of the relay illustrated in FIG. 1 with the housing cap or cover partially removed.
Figure 8:
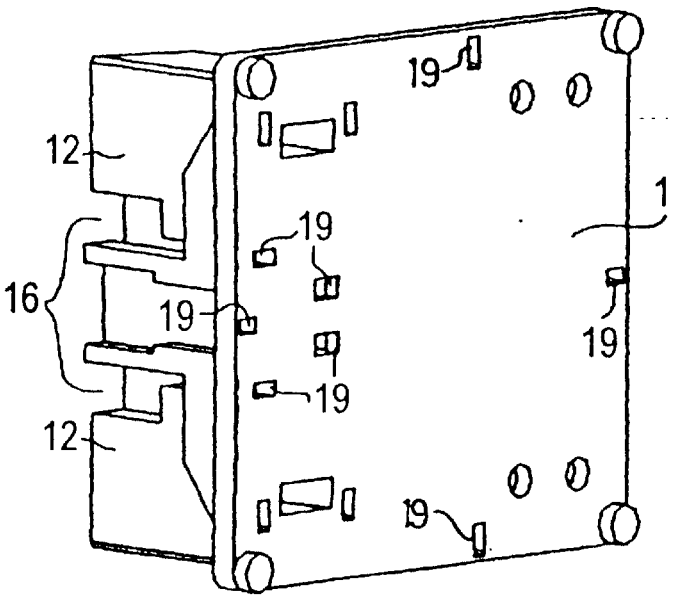
FIG. 8 is a bottom view of the base of the relay illustrated in FIG. 1.

FIG. 7 shows the relay with a partially cut open housing cap 5. At its edge, this housing cap has an inwardly offset, all around edge web 51 that engages an all around channel 52 of the base. After the cap 5 is put in place, the edge web 51 is glued in the channel 52. To this end, a liquid adhesive compound that distributes in the channel 52 by capillary action is filled in from the underside of the base 1 via the recesses 19 (see FIG. 8). For improving the capillary action, pegs (not shown) that extend into the recesses 19 are provided at the lower cap edge. As a result of the edge web 51, a double-sided adhesive surface arises between the housing cap 5 and the base 1, as a result whereof an all-sided positive lock of the housing cap is achieved, which is usually composed of extremely thin material.

As was already initially stated, the inventive design can be implemented not only as double relay but also as single relay. To this end, the described design of the double relay merely has to be cut in half along the mirror plane, as indicated in FIG. 1. The only requirement for completing the single relay is the adaptation the bisected base and the bisected coil body at the cut side, so that the closed single relay arises with a housing cap that likewise comprises half the size. The other parts can be employed unmodified for the single relay as well, so that a separate description thereof is superfluous.

Figure 9:
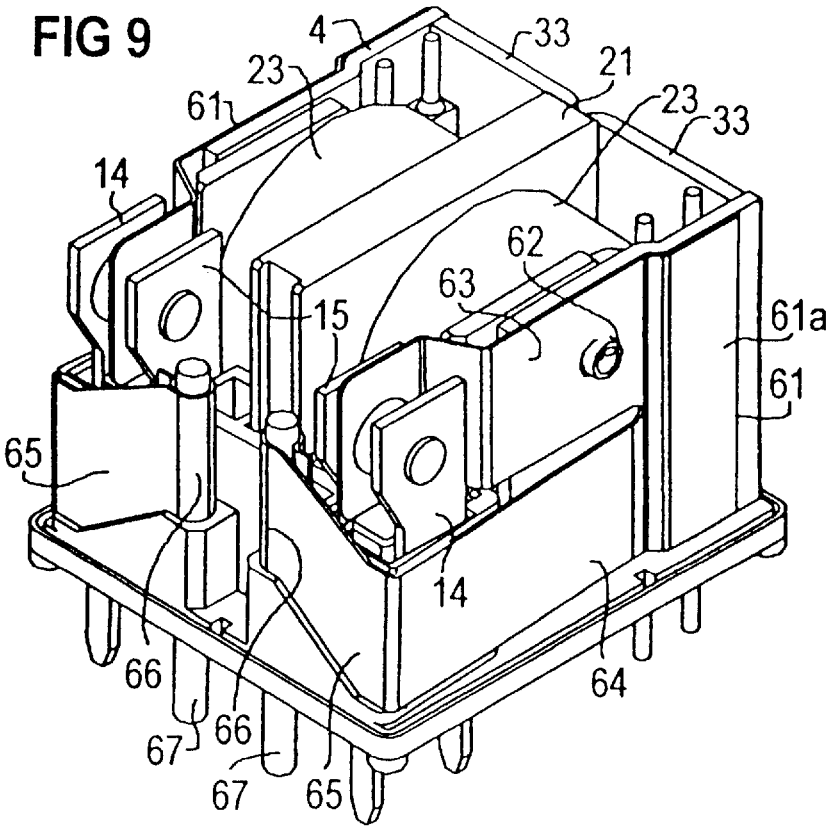
FIG. 9 is a perspective view of a second embodiment of a double relay fabricated in accordance with the present invention with a differently fashioned contact spring.

FIG. 9 shows a modification of the relay of FIG. 1. The modification, however, is comprised merely in a differently designed shape of the contact spring and of the spring carrier. Since the other parts remain unmodified, they shall not be discussed further. As in the preceding example, the contact spring 61 according to FIG. 9 has a contact leg 63 and a terminal leg 64 that lie above one another. Differing from the preceding exemplary embodiment, however, a fastening section 65 has its end shaped to form a clamp sleeve 66 that is plugged onto a round spring carrier 67. If necessary, the clamp sleeve 66 can be soldered or welded to the spring carrier 67.

Figure 10:
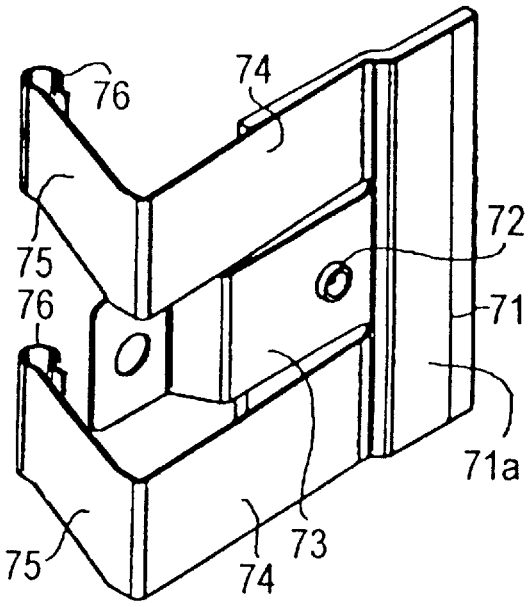
FIG. 10 is a third embodiment of a contact spring fabricated in accordance with the present invention.

FIG. 10 shows a modification of the contact spring of FIG. 9. This contact spring 71 is split in a fork-like fashion into three spring legs, namely into a middle contact leg 73 that is secured to the armature 4 via a rivet 72, and into two outer terminal legs 74 that, analogous to FIG. 9, respectively form a fastening section 74 with a clamp sleeve 76 applied to the end. As in FIG. 9, the two clamp sleeves 76 are plugged onto a spring carrier 67. As needed, however, they can also be additionally soldered or welded in this case. The armature is provided with enhanced stability by these two fastening legs.

Further modifications are conceivable. For example, the two terminal legs 74 could also be provided with a fastening section 45 according to FIG. 2. Conversely, it would also be conceivable to provide two contact legs instead of a single contact leg.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An electromagnetic relay comprising:

a base comprising a bottom surface accommodating at least one switch system, the switch system comprising a coil body accommodating a winding and an axial core, the axial core being disposed parallel to the bottom surface of the base, the core having an outer end and an inner end and extending through the winding, the inner end of the core being attached to a first leg of a yoke, the yoke including a second leg that extends next to the winding and terminates at a free end that abuttingly engages an armature, the first leg of the yoke being perpendicular to the second leg of the yoke and to the bottom surface of the base, the second leg of the yoke also being perpendicular to the bottom surface of the base, the armature extending alongside but spaced from the outer end of the core to form a gap between the armature and the outer end of the core, the armature being perpendicular to the bottom surface of the base, the base being connected to at least one fixed contact carrier, the armature being connected to a forked contact spring that includes a movable contact leg that carries a movable contact that is disposed adjacent to the fixed contact carrier for interaction therewith, the forked contact spring further comprising a terminal leg, the movable contact leg being connected to the armature, the forked contact spring extending along the armature with the armature being disposed between the contact spring and the outer end of the core, the base also being connected to a spring carrier disposed adjacent to the at least one fixed contact carrier, the terminal leg of the forked contact spring being connected to the spring carrier.

2. The relay of claim 1 wherein the terminal leg comprises a fastening section that extends toward the spring carrier at approximately a right angle, the fastening section being connected to the spring carrier.

3. The relay of claim 2 wherein the fastening section engages an insulating wall that extends upward from the base at a substantially perpendicular angle to the bottom surface of the base.

4. The relay of claim 2 wherein the spring carrier comprises an attachment tab that is attached to the fastening section of the terminal leg of the contact spring.

5. The relay of claim 2 wherein the fastening section of the terminal leg further comprises a spring tab that is attached to the base.

6. The relay of claim 2 wherein the fastening section of the terminal leg comprises sleeve that is mounted onto the spring carrier.

7. The relay of claim 1 wherein the contact spring comprises two terminal legs with the contact leg being disposed between the two terminal legs.

8. The relay of claims 1 wherein the coil is attached to a coil body, the coil body comprising at least one channel for accommodating the first leg of the yoke.

9. The relay of claim 1 wherein the inner end of the core is hard-soldered to the first leg of the yoke.

10. The relay of claim 1 wherein the at least one fixed contact carrier comprises two fixed contact carriers, both of said contact carriers being attached to the base in a spaced apart relationship, the movable contact being disposed between said fixed contact carriers for interaction therewith.

11. The relay of claim 1 further comprising two switch systems arranged in an opposing mirror image relationship on the base, the first leg of each yoke being arranged a parallel relationship to one another with an insulating distance therebetween, the two armatures being seated parallel to one another at opposite sides of the base.

12. The relay of claim 11 wherein the coil bodies of the two switch systems comprise a one-piece double coil body with a slotted common middle flange into which the two first yoke legs are disposed in a spaced parallel relationship.

13. A electromagnetic relay comprising:

a base comprising a bottom surface accommodating two switch systems arranged in an opposing mirror image configuration on the base, each switch system comprising a coil body with a winding and an axial core, the core and winding having a common axis that is parallel to the bottom surface of the base, the core having an outer end and an inner end which extends through the winding and is attached to a first leg of a yoke, the yoke including a second leg that extends next to the winding an terminates at a free end that abuttingly engages an armature, the armature extending alongside but spaced from the outer end of the core to form a gap between the armature and the outer end of the core, the base being connected to two fixed contact carriers, the armature being connected to a forked contact spring that includes a movable contact leg that carries a movable contact that disposed between the two fixed contact carriers for interaction therewith, the forked contact spring further comprising a terminal leg, the base also being connected to a spring carrier disposed adjacent to the fixed contact carriers, the terminal leg of the forked contact spring being connected to the spring carrier.

14. The double relay of claim 13 wherein each terminal leg comprises a fastening section that extends toward the spring carrier at approximately a right angle, the fastening section being connected to the spring carrier.

15. The double relay of claim 14 wherein each fastening section engages an insulating wall that extends upward from the base at a substantially perpendicular angle to the bottom surface of the base.

16. The double relay of claim 13 wherein each contact spring comprises two terminal legs with the contact leg being disposed between the two terminal legs.

17. The double relay of claim 13 wherein each inner end of each core is hard-soldered to the first leg of the yoke.

* * * * *